United States Patent [19]

Reinhardt et al.

[11] 4,344,765

[45] Aug. 17, 1982

[54] PROCESS FOR THE PREPARATION OF TRANSFER PRINTS ON OPTIONALLY REGENERATED CELLULOSE FIBERS AND THEIR MIXTURES WITH POLYESTER FIBERS

[75] Inventors: Friedrich Reinhardt, Neuenhain; Helmut Schmidt, Hofheim, both of Fed. Rep. of Germany

[73] Assignee: Hoechst Aktiengesellschaft, Frankfurt am Main, Fed. Rep. of Germany

[21] Appl. No.: 52,767

[22] Filed: Jun. 28, 1979

Related U.S. Application Data

[63] Continuation of Ser. No. 741,396, Nov. 12, 1976, abandoned.

[30] Foreign Application Priority Data

Nov. 15, 1975 [DE] Fed. Rep. of Germany ..... 2551410

[51] Int. Cl.[3] ..... D06P 5/00; D06P 3/82

[52] U.S. Cl. ..... 8/471; 8/470

[58] Field of Search ..... 8/2.5 R, 2.5 A, 29, 8/31, 471

[56] References Cited

U.S. PATENT DOCUMENTS

| | | | |
|---|---|---|---|
| 3,706,525 | 12/1972 | Blackwell et al. | 8/21 C |
| 3,853,459 | 12/1974 | Harper et al. | 8/31 |
| 3,888,624 | 6/1975 | Blackwell et al. | 8/21 C |
| 4,088,440 | 5/1978 | Leimbacher et al. | 8/2.5 R |
| 4,119,398 | 10/1978 | Purser | 8/2.5 R |
| 4,155,707 | 5/1979 | Franceschini et al. | 8/2.5 R |

FOREIGN PATENT DOCUMENTS

| | | | |
|---|---|---|---|
| 1957262 | 9/1970 | Fed. Rep. of Germany . | |
| 1591909 | 6/1970 | France . | |
| 2193908 | 2/1974 | France . | |
| 2239533 | 2/1975 | France . | |
| 50-58384 | 5/1975 | Japan | 8/2.5 |
| 50-69382 | 6/1975 | Japan | 8/2.5 |
| 1363852 | 8/1974 | United Kingdom . | |
| 1403119 | 8/1975 | United Kingdom . | |

OTHER PUBLICATIONS

Corbman, B. P., *Textiles: Fiber to Fabric,* McGraw-Hill Co., N.Y., 1975, p. 254.

*Primary Examiner*—Maria Parrish Tungol
*Attorney, Agent, or Firm*—Curtis, Morris & Safford

[57] ABSTRACT

The heat-transfer coloring process using sublimable disperse dyestuffs can be applied on cellulosic materials if these are treated with an aqueous preparation containing a thickening agent and an addition compound of a lower alkylene oxide onto a compound having active hydrogen atoms. If the thickener is a synthetic polymer containing carboxy group the alkylene oxide addition compound can be omitted.

24 Claims, No Drawings

PROCESS FOR THE PREPARATION OF TRANSFER PRINTS ON OPTIONALLY REGENERATED CELLULOSE FIBERS AND THEIR MIXTURES WITH POLYESTER FIBERS

This is a continuation, of application Ser. No. 741,396, filed Nov. 12, 1976 now abandoned.

The present invention relates to a process for the preparation of transfer prints on optionally regenerated cellulose fibers and their mixtures with polyester fibers.

In the printing of materials of synthetic fibers, especially of polyester, the so-called transfer printing has become more and more important and is widely used in the printing practice. As is already known, in this process a sublimable disperse dyestuff is applied onto a carrier material, preferably paper, and the material thus dyed is brought into contact with the substrate to be dyed under the action of heat.

The application of this interesting method to the printing of cellulose fiber materials has failed so far because the common cellulose dyestuffs are not easily sublimable. On the other hand, the disperse dyestuffs used in the transfer printing process do not dye cellulose materials with a sufficient fastness and color depth.

It has now been found that optionally regenerated cellulose fibers and their mixtures with polyester fibers can be dyed with sublimable disperse dyestuffs according to the transfer printing process if the substrate is coated with a thickener and a polyalkylene oxide addition product. In accordance with a particular development of the process of the invention, the substrate is prepared only with a polymerization product containing carboxy groups as thickening agent, i.e. the polyalkylene oxide addition product is no longer required in this case.

From German Auslegeschrift No. 1,811,796 (U.S. Pat. Nos. 3,706,525 and 3,888,624) it has been known to coat cellulose fibers or their mixtures with synthetic fibers with polyalkylene oxide addition products, thus giving them an affinity for dyestuffs which do not contain any water-solubilizing groups. If a cellulose material thus treated is used as a substrate for the transfer printing, however, only unsatisfactory dyestuff yields and uneven prints are obtained.

Surprisingly, high dyestuff yields and prints having sharp outlines are obtained if those polyalkylene oxide addition products are combined with thickening agents. In this process, from 2 to 10 parts by weight of thickener are preferably used for 1 part by weight of polyalkylene oxide addition product.

The treatment of the substrate according to the invention is preferably carried out prior to the transfer printing. However, it is also possible to contact the substrate following the transfer printing with a preparation, e.g. a padding liquor, containing the agents of the invention and to submit the fiber material subsequently to a thermal treatment in saturated steam, superheated steam, or hot air, or a combination of such thermal treatments.

As thickening agents there may be used conventional thickeners which are common for printing pastes, such as alkali metal salts of alginic acids or etherified carob bean flour. Preference is given to the polymerization products which contain carboxy groups, especially synthetic polymers containing units of low-molecular-weight mono- or dicarboxylic acids and the corresponding anhydrides which are ethylenically monounsaturated. Acids of this kind are, for example, acrylic acid and its homologues methacrylic acid and crotonic acid, maleic acid and fumaric acid and its homologues, such as citraconic acid and itaconic acid. There may also be mentioned copolymers of the before-mentioned acids with other monomers, such as ethylene, propylene or lower acrylic acid-alkyl esters or amides.

Of the polyalkylene oxide addition products, preference is given to those compounds of the general formula $$R[(C_nH_{2n}O)_mH]_x$$

in which R is a hydrogen atom, an alkyl or alkenyl radical having up to 20 carbon atoms, a phenyl radical which may be substituted by alkyl radicals having up to 10 carbon atoms, or a group of the formula

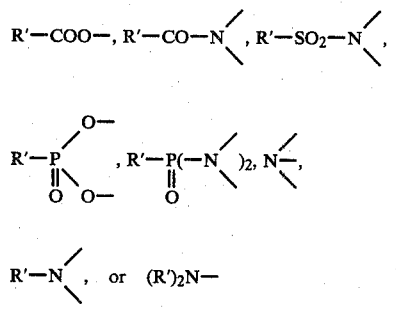

in which R' has the meaning mentioned for R, n is a number of 2 to 3, m is a number of from 1 to 40 and x is from 1 to 3, on the understanding that m.x is a number of from 4 to 40, preferably from 10 to 20. Polyethylene glycols having an average molecular weight of from 400 to 1000 are particularly preferred.

The treatment, in particular the pre-treatment of the substrate, may be effected by spraying, padding or slop-padding. In this case, the padding liquors contain per liter suitably from 10 to 500 g of from 2 to 10% aqueous preparations of thickening agents as well as from 50 to 200 g of polyalkylene oxide addition product.

In addition, the treatment baths may contain per liter from 10 to 100 g of a colorless organic compound having several groups capable of reacting with the cellulose and from 5 to 50 g of an alkaline agent or of a compound yielding an alkaline agent. As the above-mentioned reactive organic compounds there may be mentioned known cross-linking agents which contain several acryl, vinylsulfonyl, esterified $\beta$-hydroxy-ethylsulfonyl groups or reactive chlorine atoms bound to heterocycles, such as divinylsulfone, methylene-bisacrylamide or tris-acryloylhexahydro-1,3,5-triazine.

Besides, there may be added to the reaction mixtures for the preparation bath from 1 to 100 g per liter of products which are obtained by way of polymerization, polycondensation or polyaddition, and which are used, for example, in the pigment printing as binding agents.

As monomers, the following compounds may be mentioned for these products: $\alpha,\beta$-olefinically unsaturated mono- and dicarboxylic acids, such as acrylic acid, methacrylic acid, $\alpha$-chloroacrylic acid, crotonic acid, maleic acid and its anhydride, fumaric acid, itaconic acid, as well as their salts and derivatives, such as acrylic and methacrylic acid amide, acrylic and methacrylic nitrile, esters of the acylic and methacrylic acids, especially those having saturated low-molecular monovalent aliphatic or cycloaliphatic alcohols, moreover, monoesters of the above-mentioned olefinically unsaturated carboxylic acids with bivalent saturated alcohols, such as 2-hydroxyethyl-methacrylate, 2-hydroxy-propyl-methacrylate, 4-hydroxybutyl-methacrylate, 2-hydroxyethyl-acrylate, 2-hydroxypropyl-acrylate, 4-hydroxybutyl-acrylate, as well as the corresponding diesters.

Further monomers are aromatic monovinyl compounds, such as styrene, α-methylstyrene, vinyltoluene, p-chlorostyrene, and styrene-sulfonic acid, esters of unsaturated alcohols, such as vinyl acetate and vinyl propionate, vinyl ethers, vinyl ketones, unsaturated halogen compounds, such as vinylchloride and vinylidene chloride and chloroprene, N-vinyl-pyrrolidone and N-vinylimidazole, alkylene diamides and alkylene diesters of acrylic acid and methacrylic acid, diallyl ether of $C_2$–$C_6$-alkylene glycols and diallylesters of $C_2$–$C_6$-alkylene-dicarboxylic acids and phthalic acids, as well as monomers containing halohydrine groups, furthermore, olefinically unsaturated hydrocarbons, such as ethylene, propylene, butadiene, isoprene, and dimethyl butadiene. Other suitable monomers are the methylolacryl- and methacrylamides as well as their Mannich bases and methylolethers, moreover, unsaturated sulfonic acids, such as vinyl-, allyl- and methallyl-sulfonic acids, basic esters of acrylic and methacrylic acid, for example, methacrylic acid-dimethylamino-ethylesters as well as their quaternization products, besides, diallylammonium compounds and vinyl pyridine.

Moreover, it is possible to add to the above-described treatment bath, per liter, from 1 to 100 g of intermediate products capable of forming a synthetic resin or generally showing a cross-linking reaction in an acid medium, such as, for example, addition products of formaldehyde to aminotriazines, hydroxydiaminotriazines, dihydroxyaminotriazines, triazones, guanamines, urea, thiourea, ethylene ureas, dicyanodiamide, or methylol melamines etherified partially or completely with $C_1$–$C_5$-alkanols, methylol ureas or methylolated derivatives of propylene-, guanyl- or acetylene urea or 4,5-dihydroxyimidazolidone-(2), which derivatives have been etherified partially or completely with $C_1$–$C_5$-alkanols. There are mentioned, moreover, epoxy compounds, for example, the 3,4-epoxy-6-methyl-chlorohexylmethylester of 3,4-epoxy-6-methyl-cyclohexane-carboxylic acid.

Besides, there may be added as cross-linking catalysts salts of weak bases and mineral acids, for example, ammonium salts or salts of organic amines, furthermore, ester of mono- or dicarboxylic acids or sulfonic acids, such as, for example, dimethyloxalate or methyl-p-toluene-sulfonate.

The carrier materials for the transfer printing may be printed, padded or slop-padded in common manner. As far as conventional printing pastes are used for this purpose, the above-mentioned thickeners may serve as thickening agents. However, the printing may also be carried out by means of the common printing inks containing varnish.

The transfer printing itself is effected in known manner under conditions in which the dyestuff may sublime from the carrier onto the substrate. In this process it may be advantageous to work under reduced pressure. The transfer printing is performed generally at a temperature in the range of from about 150° to 220° C., for example on a pressing machine at 200° C., within 10 to 90 seconds, or on heated calenders at a temperature of from about 190° to 210° C. within about 10 to 80 seconds.

The following Examples serve to illustrate the invention. All parts and percentages are by weight unless otherwise stated.

EXAMPLE 1

A machine glazed sodium kraft paper having a weight per square meter of 70 g was printed on the smooth side with a printing ink of the following composition:

60 Grams of the pulverulent dyestuff of the formula

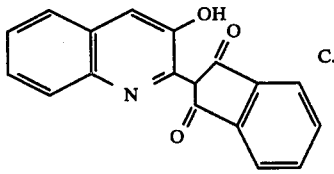

C.I. 47 020 in a commercial formulation were dispersed in 100 g of lukewarm water. The dispersion was stirred into 600 g of a thickener consisting of equal parts of a 4% aqueous solution of a highly viscous sodium alginate and a 10% aqueous solution of a carob bean flour-methylether.

The mixture was made up to 1000 g with water or thickening agent.

The printed and dried paper was brought into close contact with a cotton fabric on a pressing machine for 60 seconds at 200° C., which fabric had been padded before on a padder with a bath having the composition shown below (liquor pick-up: 80 to 90%) and dried subsequently:

100 g/l of a 5% aqueous sodium alginate solution 100 g/l of a polyethylene-glycol having a molecular weight of 1000.

As a result, the cotton fabric showed a reddish-yellow print of a medium color depth which had good fastness properties.

EXAMPLE 2

A white-bleached wood-free flexographic printing paper was printed with a printing ink having the following composition:

100 grams of the dyestuff of the formula

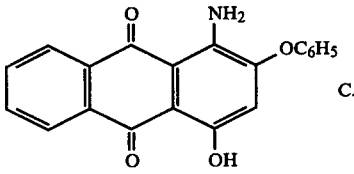

C.I. 60 756 in a commercial liquid formulation were introduced into 600 g of a thickening mixture consisting of equal parts of the 2.5% aqueous solution of a hydroxethylated cellulose (content of 35% of ethylene oxide) and a 50% aqueous solution of the ammonium salt of a copolymer of vinyl acetate and crotonic acid (molar ratio of 94:6, molecular weight 190 000). The mixture was made up to 1000 g with water or thickening agent.

The printed and dried paper was maintained in close contact with a spun rayon fabric on a special calender which could be heated, for 60 seconds at a temperature of 210° C., the fabric having been slop-padded before with the aqueous solution of an ammonium polyacrylate having a molecular weight of 800 000 and dried subsequently.

The spun rayon fabric showed a pink print having good general fastness properties.

EXAMPLE 3

A paper suitable for the transfer printing was slop-padded by means of a blotch roller with a printing ink having the following composition:

200 Grams of the dyestuff of the formula

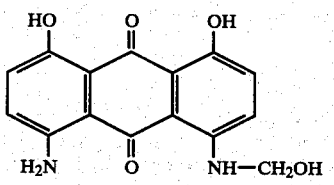

in a commercial liquid formulation were stirred onto 800 g of the aqueous solution of a copolymer of ethylene and maleic acid anhydride (molar ratio 1:1, molecular weight 3 000 000).

In a special calender capable of being heated, the slop-padded and dried paper was brought into close contact with a knitted fabric made or regenerated cellulose fibers showing a good wet fastness (®MODAL fibers) for 80 seconds at a temperature of 190° C. This knitted fabric was treated before by way of padding (liquor pick-up 90%) with the bath described below and by subsequent drying.

Padding liquor:

2 Parts of a 2% aqueous solution of an ammonium polyacrylate having a molecular weight of 3 000 000

2 parts of a 2% aqueous solution of a copolymer of ethylene and maleic acid anhydride (molar ratio of 1:1, viscosity of a 2% aqueous solution at 25° C. 85 P, Bloomfield viscometer)

1 part of an addition product of 20 mols of ethylene oxide on p-toluene-sulfonamide.

In the transfer process a deep level blue dyeing was obtained which showed satisfactory fastness properties.

EXAMPLE 4

An intaglio printing paper was printed with an intaglio printing ink containing usual solvents and varnish, which ink contained 10% of the dyestuff of the formula

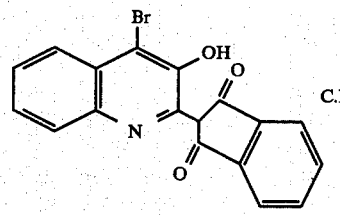

C.I. 47 023 that was free from diluents.

The dry paper print was maintained in close contact with a cotton fabric on a pressing machine for 30 seconds at 200° C., the fabric having been submitted to a pre-treatment by being sprayed (liquor pick-up of 40 to 50%) with an aqueous bath having the composition shown below and by subsequent drying:

100 g/l of a 4% aqueous sodium alginate solution 100 g/l of tris-acryloyl-hexahydro-1,3,5-triazine 100 g/l of polyethylene-glycol 600

20 g/l of sodium hydrogencarbonate.

In the course of the transfer printing process a deep yellow print was obtained which showed good fastness properties.

EXAMPLE 5

A paper suitable for the transfer printing was printed with a printing ink having the following composition:

100 Grams of the pulverulent dyestuff of the formula

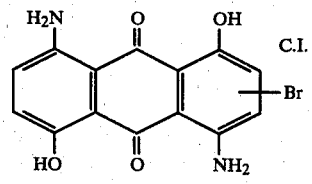

C.I. 63 285 were introduced into 600 g of the thickening mixture described in Example 2. The mixture was made up to 1000 g with water or thickening agent.

The printed and dried paper was brought into close contact with a fabric consisting of 65% of polyethylene-glycol-terephthalate fibers and 35% of cotton fibers on a transfer calender, for 60 seconds at 200° C., which fabric had before been prepared by slop-padding with a mixture of 2 parts of the 1% aqueous solution of a polyacrylic acid having a molecular weight of 600 000 and 1 part of bis-polyhydroxyethyl-octanephosphonate (with a total of 5 ethylene oxide units).

As a result, a full blue print was obtained which showed good fastness properties.

EXAMPLE 6

A transfer printing paper was slop-padded with a printing ink having the following composition:

100 g of the dyestuff of the formula

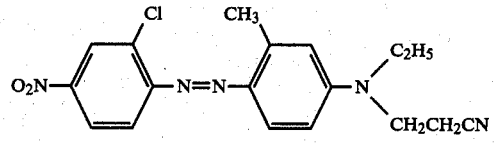

in a commercial liquid formulation were introduced by stirring into 800 g of the thickening mixture described in Example 3. The mixture was made up to 1000 g with water or thickening agent.

The printed and dried paper was maintained in close contact with a fabric consisting of 50% of polyethylene-glycol-terephthalate fibers and 50% of spun rayon on a special calender capable of being heated, for 60 seconds at a temperature of 200° C., the fabric having been treated before by being padded (liquor pick-up of 80%) with a bath having the following composition:

3 Parts of the 2% aqueous solution of a copolymer of metacrylic acid and methacrylic acid butylester (molar ratio of 4:1, molecular weight 300 000), 1 part of polyethylene-glycol having a molecular weight of 400.

As a result, a red dyeing was obtained which showed satisfactory fastness properties.

EXAMPLE 7

A paper suitable for the transfer printing process was printed with a printing ink having the following composition:

150 Grams of thio-indigo in a commercial paste formulation were stirred into 800 g of the thickening mixture described in Example 3. The mixture was made up to 1000 g with water or thickening agent.

The printed and dried paper was brought into close contact with a fleece consisting of 50% of polyethylene-glycol-terephthalate fibers and 50% of cotton fibers on a pressing machine for 90 seconds and at a temperature of 200° C., the fleece having been treated before like the fabric mentioned in Example 5.

A bright pink print was obtained which had good general fastness properties.

EXAMPLE 8

A transfer printing paper printed according to Example 5 was maintained in a special calender which could be heated in a close contact with a fabric consisting of 65% of polyethylene-glycol-terephthalate fibers and 35% of cotton for 60 seconds at 200° C., the fabric having been treated before by being padded (liquor pick-up of 80%) with a bath having the following composition:

950 Parts of the 2% aqueous solution of an ammonium polyacrylate having a molecular weight of 3 000 000, and 50 parts of the 50% aqueous solution of hexamethylolmelaminehexamethylether.

As a result, a full blue print was obtained which showed good fastness properties.

EXAMPLE 9

A paper suitable for the transfer printing process was slop-padded by means of a blotch roller with a printing ink having the following composition:

70 Grams of the 40% liquid formulation of the dyestuff of the formula

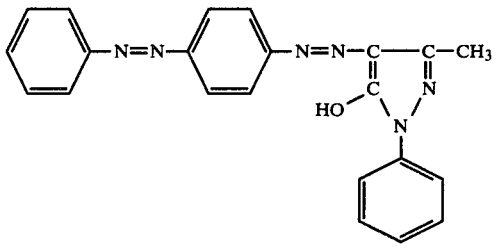

were introduced by stirring into 800 g of the aqueous solution of a copolymer of ethylene and maleic acid anhydride (molar ratio of 1:1; molecular weight 3 000 000).

The slop-padded and dried paper was brought into close contact with a mixed fabric of 50% of polyethylene-glycol-terephthalate fibers and 50% of regenerated cellulose fibers showing a good wet fastness (®MODAL fibers) on a special calender capable of being heated, for 60 seconds at 200° C. This fabric had been treated before by being padded (liquor pick-up of 80%) with the padding bath described below and by being dried subsequently.

Padding liquor:

400 Parts of the 2% aqueous solution of an ammonium polyacrylate having a molecular weight of 1 000 000

450 parts of the 2% aqueous solution of a copolymer of ethylene and maleic acid anhydride (molar ratio of 1:1; viscosity of a 2% aqueous solution at 25° C. 85 P, Bloomfield viscometer)

120 parts of a polyethylene-glycol having a molecular weight of 600

30 parts of the 40% aqueous dispersion of a copolymer of butyl acrylate, vinyl acetate and N-methylolacrylamide (molar ratio of 65:25:5).

In the transfer process a golden yellow dyeing was obtained which showed good general fastness properties.

EXAMPLE 10

An intaglio printing paper was printed with an intaglio printing ink containing usual solvents and varnish which also contained 10% of the dyestuff of the formula

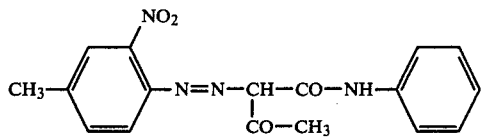

that was free from diluents.

The dry paper print was maintained in a close contact with a mixed fabric consisting of 70% of polyethylene-glycol-terephthalate fibers and 30% of regenerated cellulose fibers on a pressing machine for 60 seconds at 210° C., which fabric had been treated by slop-padding with a bath (liquor pick-up of 70%) having the following composition and had been dried subsequently:

850 Parts of the 2% aqueous solution of an ammonium acrylate having a molecular weight of 1 500 000

100 parts of a polyethylene-glycol having a molecular weight of 400

30 parts of the 50% aqueous solution of hexamethylolmelaminepentamethylether 20 parts of the 35% aqueous dispersion of a copolymer of acrylic acid-ethylester, acrylonitrile and the butylether of N-methylol-methacrylamide (molar ratio of 75:10:15).

In the transfer printing a yellow print was obtained which showed good fastness properties.

What is claimed is:

1. A process for coloring a fabric containing natural or regenerated cellulose fibers, which comprises contacting said fabric at a temperature of 180° to 220° C. with a carrier sheet which is covered with a layer containing a disperse dyestuff capable of subliming in said temperature range, said fabric being impregnated prior to or after said contacting with a thickening composition consisting essentially of (1) a synthetic polymer having carboxy groups or an alkali metal or ammonium salt thereof, or (2) an aqueous liquor containing, per liter, 10 to 500 g of an aqueous solution or dispersion containing 2 to 10% by weight of a thickening agent and 50 to 200 g of polyalkylene oxide compound.

2. A process as claimed in claim 1, wherein said fabric is impregnated with an aqueous solution or dispersion of a thickening agent.

3. A process as claimed in claim 1, wherein said lower polyalkylene oxide compound is an addition compound of ethylene oxide, propylene oxide or a mixture of ethylene and propylene oxide onto a compound having reactive hydrogen atoms.

4. A process as claimed in claim 3, wherein the compound having reactive hydrogen atoms is water, an alcohol, a phenol, a carboxylic or phosphonic acid, ammonia, a primary or secondary amine or an amide or a carboxylic, sulfonic, or phosphonic acid.

5. A process as claimed in claim 3, wherein said addition compound contains 4 to 40 alkylene oxide units.

6. A process as claimed in claim 3, wherein said addition compound contains 10 to 20 alkylene oxide units.

7. A process as claimed in claim 3, wherein said addition compound is a polyethylene glycol of a molecular weight of 400 to 1000.

8. A process as claimed in claim 3, wherein said addition compound has the formula $$R[(C_nH_{2n}O)_mH]_x,$$

in which R is hydrogen, alkyl or alkenyl of up to 20 carbon atoms, phenyl or alkyl phenyl with one or more alkyl substituents having in total up to 10 carbon atoms, or a group of the formula

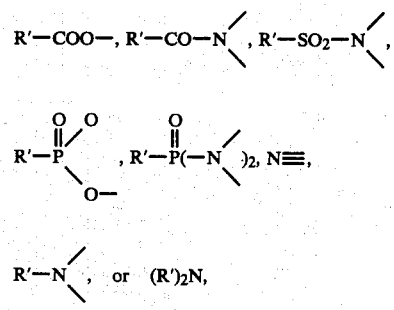

in which R′ is hydrogen, alkyl or alkenyl of up to 20 carbon atoms, phenyl or alkyl phenyl with one or more alkyl substituents having in total up to 10 carbon atoms, n is a number of 2 to 3, m is a number of 1 to 40 and x is 1, 2 or 3, with the proviso that m.x is 4 to 40.

9. A process as claimed in claim 1, wherein said fabric consists essentially of natural cellulose fibers, regenerated cellulose fibers, a blend thereof or a blend of one or both of said fibers with polyester fibers.

10. A process as claimed in claim 1, wherein said contacting is performed by pressing said carrier sheet onto said fabric.

11. A process as claimed in claim 10, wherein said pressing is effected by means of a heated calender.

12. A process as claimed in claim 10, wherein said contacting is performed in vacuo.

13. A process as claimed in claim 1, wherein said carrier sheet consists of paper or aluminum.

14. A process as claimed in claim 1, wherein said carrier sheet consists of paper.

15. A process as claimed in claim 1, wherein said layer has been applied onto said carrier sheet by printing, padding, slop-padding or spraying.

16. A process as claimed in claim 1, wherein said fabric is impregnated before it is contacted with said carrier sheet.

17. A process as claimed in claim 1, wherein said fabric is impregnated after it is contacted with said carrier sheet, which impregnation is followed by a thermal aftertreatment.

18. A process as claimed in claim 1, wherein said fabric is impregnated by spraying, padding or slop-padding.

19. A process as claimed in claim 1, wherein the temperature is 180° to 220° C.

20. A process as claimed in claim 1, wherein the temperature is 190° to 210° C.

21. A process as claimed in claim 1, wherein said contacting takes 10 to 90 seconds.

22. A process as claimed in claim 1, wherein per part by weight of said lower polyalkylene oxide compound 2 to 10 parts by weight of said thickening agent are applied onto said fabric.

23. A process as claimed in claim 1, wherein said liquor contains additionally per liter 1 to 100 g of a binder as used in pigment printing.

24. A process as claimed in claim 1, wherein said liquor contains additionally 1 to 100 g of a reactant resin.

* * * * *